US007607623B2

(12) United States Patent
Wesolowski

(10) Patent No.: US 7,607,623 B2
(45) Date of Patent: Oct. 27, 2009

(54) CONTAINER DEVICE FOR HOLLOW RUNG LADDER

(75) Inventor: Francis J. Wesolowski, Jefferson, MA (US)

(73) Assignee: Stephan P. Williams, Worcester, MA (US), part interest ( * ) Notice: Subject to any disclaimer, the term of this patent is extended or adjusted under 35 U.S.C. 154(b) by 0 days.

(21) Appl. No.: 11/614,102

(22) Filed: Dec. 21, 2006

(65) Prior Publication Data

US 2008/0149793 A1 Jun. 26, 2008

(51) Int. Cl.
*E06C 7/14* (2006.01)

(52) U.S. Cl. ..... 248/210; 248/213.2

(58) Field of Classification Search ..... 248/210, 248/211, 238; 182/129; 220/737, 754, 756, 220/771, 475, 570, 751
See application file for complete search history.

(56) References Cited

U.S. PATENT DOCUMENTS

| | | | | | |
|---|---|---|---|---|---|
| D188,758 | S | * | 8/1960 | Parker | D25/69 |
| 3,223,369 | A | * | 12/1965 | Benninger, Jr. | 248/210 |
| 4,445,659 | A | * | 5/1984 | LaChance | 248/210 |
| 4,523,733 | A | * | 6/1985 | Lunden, Jr. | 248/210 |
| 4,560,127 | A | | 12/1985 | Ippolito | 248/210 |
| 4,660,794 | A | * | 4/1987 | Given | 248/238 |
| 4,662,594 | A | * | 5/1987 | Dubis | 248/238 |
| 4,824,060 | A | | 4/1989 | Korda | 248/210 |
| 4,834,438 | A | * | 5/1989 | Haidet | 294/31.2 |
| D324,272 | S | | 2/1992 | Thiel | D25/68 |
| 5,293,957 | A | | 3/1994 | Lunden, Jr. | 182/129 |
| 5,316,251 | A | | 5/1994 | McGraw | 248/210 |
| 5,649,682 | A | | 7/1997 | Martin | 248/210 |
| 5,934,632 | A | * | 8/1999 | Weaver | 248/210 |
| 5,960,905 | A | * | 10/1999 | Gardner | 182/129 |
| 5,971,103 | A | | 10/1999 | Mulvaney | 182/129 |
| 6,241,204 | B1 | * | 6/2001 | Bermes | 248/210 |
| 6,254,045 | B1 | * | 7/2001 | Oatsvall | 248/210 |
| 6,260,663 | B1 | | 7/2001 | Combs | 182/129 |
| 6,338,459 | B1 | | 1/2002 | Biggs | 248/210 |
| 6,352,135 | B1 | | 3/2002 | Jones | 182/129 |
| 6,604,721 | B2 | | 8/2003 | Ahl et al. | 248/210 |
| 6,824,115 | B1 | | 11/2004 | Batson | 248/238 |
| 2007/0221802 | A1 | | 9/2007 | New, Sr. et al. | |

* cited by examiner

*Primary Examiner*—Gwendolyn Baxter
(74) *Attorney, Agent, or Firm*—Stephan P. Williams

(57) ABSTRACT

Disclosed is a simple, inexpensive utility container device for use with a hollow rung ladder. The container device includes a rung insert member and a container for holding a liquid material. The container includes a pair of aligned openings that are offset rearwardly so that the container automatically tips to a suitable forward angle to make it easier for the user to access the contents of the container. In a preferred device, the rung insert member will include a rung insertion portion at each end of the rung insert member, with a container holding portion therebetween, to permit the device to be used in either right or left hand mode. In an alternative embodiment, the rung insert member and container are an integral unit.

20 Claims, 8 Drawing Sheets

CONTAINER DEVICE FOR HOLLOW RUNG LADDER

BACKGROUND OF THE INVENTION

The present invention relates to a container device for use in conjunction with a hollow rung ladder. A preferred use for the utility container will be to hold paint while the ladder is being used by a painter, thereby freeing the painter's hands while conveniently holding the paint at a readily accessible location adjacent the painter's work area. However, the container may also be used to hold other types of liquids that one might apply to a structure while standing on a ladder.

In U.S. Pat. No. 5,934,632 there is described a utility can holder for use with hollow rung ladders. The device includes an annular support member for holding the can and a rung insert member attached at one end to the annular support member. The other end of the rung insert member may be inserted into a hollow ladder rung. The rung insert member is attached to the annular support member such that its longitudinal axis intersects the center of the annular support member. This central or mid-point attachment enables the device to be inserted on either side of the ladder and permits the paint can to be self-leveling.

In U.S. Pat. No. 6,260,663 there is described a paint can holder for use with a hollow rung ladder. The device includes a bucket portion connected to an arm portion as a one-piece molded unit. The bucket portion is designed to hold both one gallon and one quart paint cans. The arm portion, one end of which can be inserted into a hollow rung, is connected to the bucket portion at its midpoint or central axis so that the paint can is self-leveling.

In U.S. Pat. No. 5,316,251 there is also described a paint can holder for hollow rung ladders that is self-leveling in two planes. However, instead of an annular support member, as described above, this device includes a yoke-shaped frame member with a pair of notches sized and spaced to receive the handle bosses of a standard paint can.

In U.S. Pat. No. 6,352,135 there is described an accessory for use with a hollow rung ladder that includes a holding arm for insertion into the hollow rung of the ladder. A paint can holder may be removably attached at one end of the holding arm and an accessory tray may be removably attached at the opposite end of the holding arm. The paint can holder includes a pair of U-shaped brackets depending from a circular support band. The device includes a ratchet mechanism to allow the paint can holder or accessory tray to self-level or to be set at a desired configuration.

In U.S. Pat. No. 5,649,682 there is described a paint can holder for use with a hollow rung ladder. The device is essentially a flat strip of metal of a size suitable to fit inside the hollow ladder rung. One end of the strip is bent into an open-ended ring shape that can be tightened around a paint can held therein.

In U.S. Pat. No. 4,824,060 there is described a paint can holder for use with a hollow rung ladder. The device includes a rod for insertion into the hollow ladder rung. One end of the rod is threaded so that a paint can holder may be secured via a wing nut. The paint can holder is a U-shaped frame with a cylindrical top piece that conforms to the diameter of a paint can. Other holder and tray accessories are disclosed in U.S. Pat. No. 6,824,115, U.S. Pat. No. 5,293,957, U.S. Pat. No. 5,971,103 and U.S. Pat. No. D324,272.

The foregoing patent disclosures are incorporated herein by reference. While a number of paint can holders are described in the art, it would be highly desirable to produce a simple, inexpensive utility container for use with a hollow rung ladder. In particular, it would be highly desirable to provide such a container that would automatically tip to a suitable forward angle that would make it easier for the user to access the contents of the container.

SUMMARY OF THE INVENTION

The present invention embraces a container device for use with a hollow rung ladder. The container device comprises, in combination, a rung insert member and a container for holding a liquid material. The rung insert member includes a rung insertion portion and a container holding portion, wherein the rung insertion portion has a width or diameter sufficient to snugly, but removably, fit within the hollow rung of a ladder and a length sufficient to enter at least part-way into said hollow rung.

The container includes a pair of aligned openings dimensioned and arranged to permit the container holding portion of the rung insert member to be inserted there through and thereby support the container. The pair of aligned openings is offset rearwardly from the central horizontal axis of the container, thereby allowing the container to tip forwardly, at least slightly to moderately, when the container includes liquid material. The container holding portion of the rung insert member has a length at least sufficient to pass through the pair of aligned openings in the container.

DESCRIPTION OF PREFERRED EMBODIMENTS

Figure 1:
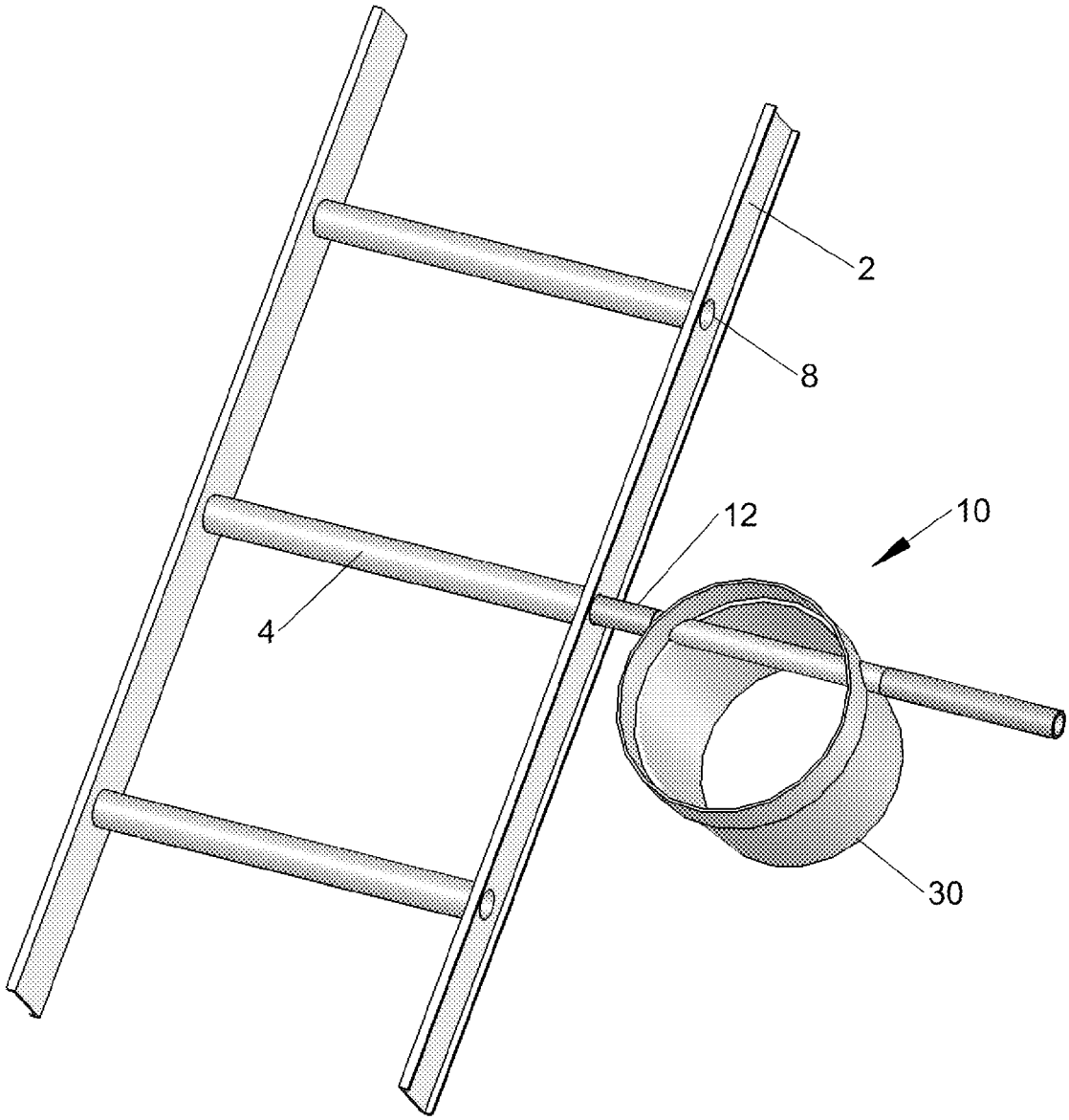
FIG. 1 is a perspective view of a first embodiment of the invention, shown installed on a hollow rung ladder.
Figure 2:
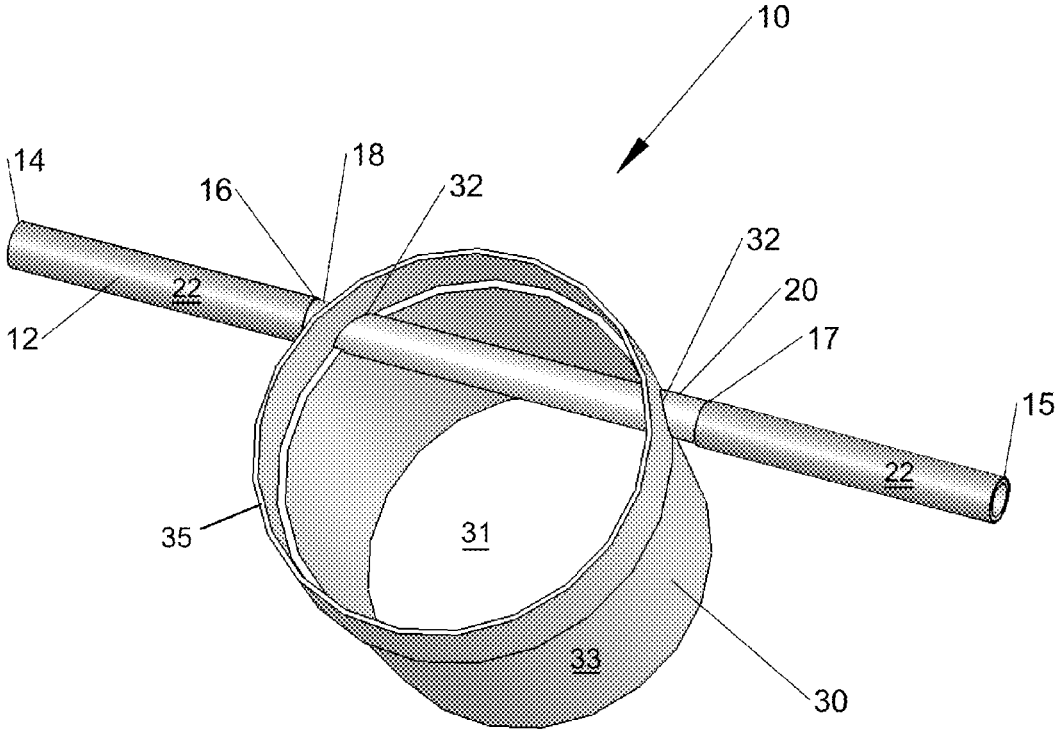
FIG. 2 is a perspective view of the embodiment of FIG. 1 shown without the ladder.

Referring to FIGS. 1 to 4, the container device 10 is designed for use with a hollow rung ladder 2 having a plurality of hollow rungs 4, each rung having a rung opening 8 that extends the full length of the rung. Generally, each rung of a typical hollow rung ladder will have a flat upper surface (not shown) to facilitate standing thereon.

The container device 10 comprises, in combination, a rung insert member 12 and a container 30 for holding a liquid material. The rung insert member 12 includes a rung insertion portion 14, 16 that extends from one end 14 of the rung insert member to a predetermined point 16 along the length of the rung insert member, and a container holding portion 18, 20 that extends partway along the length of the rung insert member. The rung insertion portion 14, 16 should be cross-sectionally dimensioned (i.e., its width, diameter, thickness) to snugly, but removably, fit within the hollow rung of a ladder and should have a length sufficient to extend at least part-way into the hollow rung, preferably at least about five inches into the hollow rung, more preferably at least about six inches into the hollow rung, up to the full length of the hollow rung (about 16 to 18 inches), or even slightly beyond the end of the hollow rung (see FIG. 8). Typically, the container holding portion will extend from a point 18, which is proximate (e.g., 0-6 inches, preferably 0-4 inches, most preferably 0.5 to 2 inches) to the aforementioned predetermined point 16 of the rung insertion portion, to a point 20 such that the container holding portion 18, 20 has a length sufficient to approximately span the diameter of the container (e.g., about 8-16 inches, preferably about 10-12 inches).

In a preferred embodiment, the rung insert member 12 may optionally include an additional rung insertion portion 15, 17, that extends from the other (i.e., opposite) end 15 of the rung insert member to a predetermined point 17 along the length of the rung insert member (i.e., essentially a mirror image of the rung insertion portion 14, 16). In this embodiment, the container holding portion 18, 20 is located between the rung insertion portion 14, 16 and the additional rung insertion portion 15, 17. Point 20, which defines one end of the container holding portion, will be proximate (e.g., 0-6 inches, preferably 0-4 inches, most preferably 0.5 to 2 inches) to the aforementioned predetermined point 17 of the additional rung insertion portion. The optional additional rung insertion portion permits the device to be inserted on the opposite side of the ladder so that the device can be utilized in either a right-hand or left-hand mode. In this embodiment, the non-inserted rung insertion portion can advantageously serve as a handle to permit the user to grasp the device for insertion or removal. In a highly preferred form of this embodiment, the rung insertion portion 14, 16 and the additional rung insertion portion 15, 17 will each be 6 to 8 inches in length, the container holding portion 18, 20 will be 10 to 12 inches long, the distance 16, 18 between the container holding portion and the rung insertion portion will be 0 to 4 inches, and the distance 17, 20 between the container holding portion and the additional rung insertion portion will be 0 to 4 inches.

The rung insertion portion may be any desired shape, including flat, round (as shown), elliptical, or D-shaped (similar to the interior shape of a typical hollow rung). The rung insertion portion may include at least one external spring member (not shown), such as a leaf type spring, along its length that is adapted to be compressed by the inner wall of the hollow rung during insertion, thereby creating a snug fit. The end 14 of the rung insert member may preferably include a locking member (not shown) to prevent the rung insertion portion from accidentally slipping out of the hollow rung. The locking member may be integral with the rung end or it may be a separate piece attachable to the rung end after insertion through the hollow rung. The locking member may be a pivoted latch plate, as shown in U.S. Pat. No. 4,824,060 (incorporated herein by reference) that swings into a locking or retaining position after passing through the hollow rung. Alternatively, the locking member may be a pair of opposed flexible locking tabs, as shown in U.S. Pat. No. 5,934,632 (incorporated herein by reference), that spring outward after passing through the hollow rung. In addition, the locking member may be a pin, a clip or a cotter pin that can be inserted into the rung end after insertion, or it may be a threaded wing nut or plate that can be threaded onto the rung end after insertion through the hollow rung. In a preferred embodiment, the rung insertion portion 14, 16 (and optional additional rung insertion portion 15, 17) comprises an elastomeric surface 22 that will assist in retaining the rung insertion portion within the hollow rung. The elastomeric surface may be smooth or it may have a surface pattern, such as ribs, diamonds, hatching, etc. to facilitate its gripping/retaining ability.

The container 30 has a base 31 and a continuous surrounding sidewall 33 that extends upwardly from the base to an open upper rim 35. It may be any desired shape including, for example, a round bucket or pail with either vertical sidewalls (i.e., the bottom rim or base has the same diameter as the upper rim), as shown, or inwardly sloping sidewalls (i.e., the bottom rim or base has a smaller diameter than the upper rim). The container includes a pair of aligned openings 32 located near the open upper rim that are dimensioned and arranged to permit the container holding portion 18, 20 of the rung insert member to be inserted therethrough and thereby support the container. The pair of aligned openings 32 is offset rearwardly from the central horizontal axis 34 of the container (see FIGS. 3 and 4), thereby allowing the container to tip forwardly, at least slightly to moderately, when the container includes liquid material. For the sake of clarity, the central horizontal axis 34 of the container is the container axis that extends parallel to the longitudinal axis of the rung insert member and equidistant from the front 36 and rear 38 walls of the container, at or near the open upper rim of the container.

The container holding portion 18, 20 of the rung insert member has a length at least sufficient to pass through the pair of aligned openings in the container. It may be any desired shape, including the same shape as the rung insertion portion or a different shape. Preferably, the container holding portion will be round (as shown), or at least have a rounded upper surface, so that the container may freely rotate about its axis. In addition, the container holding portion may optionally include a container retention member (not shown) to prevent the container from accidentally slipping off the container holding portion. The container retention member may be a notch in the container holding portion that engages a surface that defines one of the aligned openings, or it may be a pin, a clip, a cotter pin or some other type of clasp inserted or attached along the container holding portion.

Figure 5:
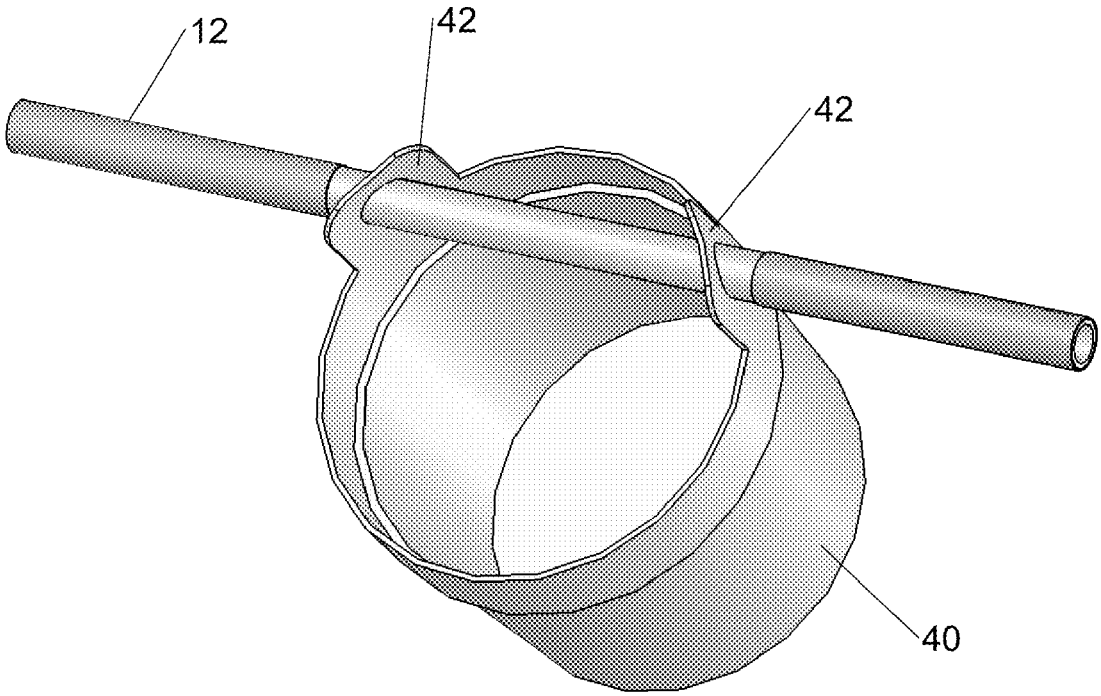
FIG. 5 is a perspective view of a second embodiment of the invention.

FIG. 5 illustrates a second embodiment of the invention. In this embodiment, the container 40 includes a pair of aligned openings in the form of ear loops 42 that extend above the top rim of the container. These ear loops are preferably affixed to the container at each end of the loop, as shown, for greater strength. The term "affixed" is intended to embrace any type of attachment, including integral attachment (e.g., when the ear loops are molded as part of the container). In addition, the ear loops may also be affixed to the container at only one end and take the shape of an inverted J (e.g., as described below with respect to FIG. 6).

Figure 6:
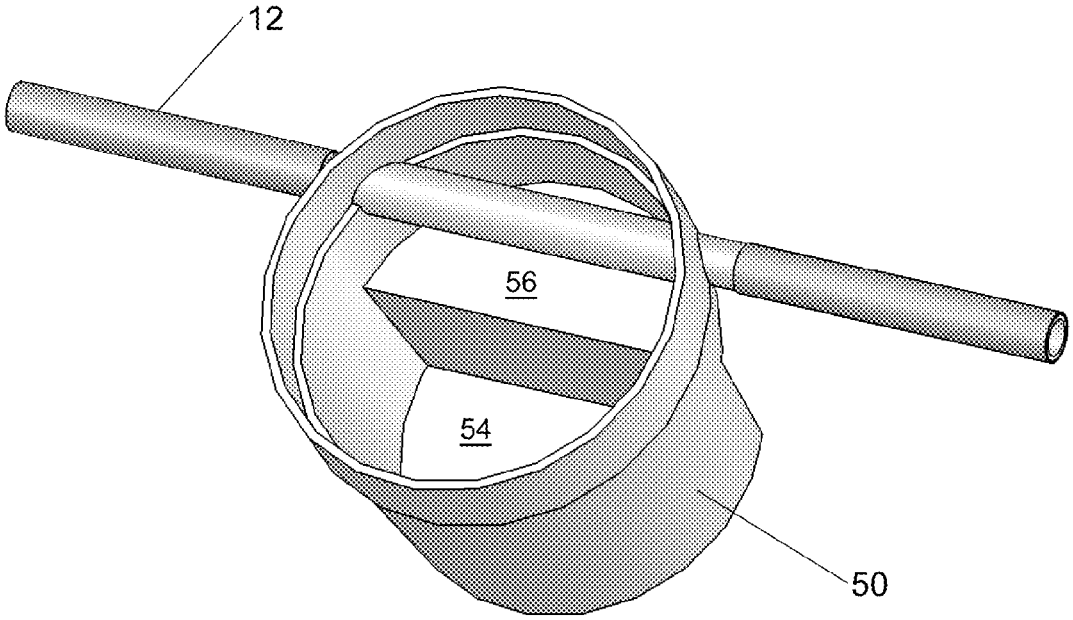
FIG. 6 is a perspective view of a third embodiment of the invention.

FIG. 6 illustrates a third embodiment of the invention. In this embodiment, the container 50 includes a stepped bottom surface that includes a lower step 54 and an upper step 56. Such a stepped surface changes the center of gravity of the container, thereby permitting the container to tilt forward more easily. It also permits the container to hold somewhat more liquid (e.g., paint) without becoming excessively heavy.

Figure 7:
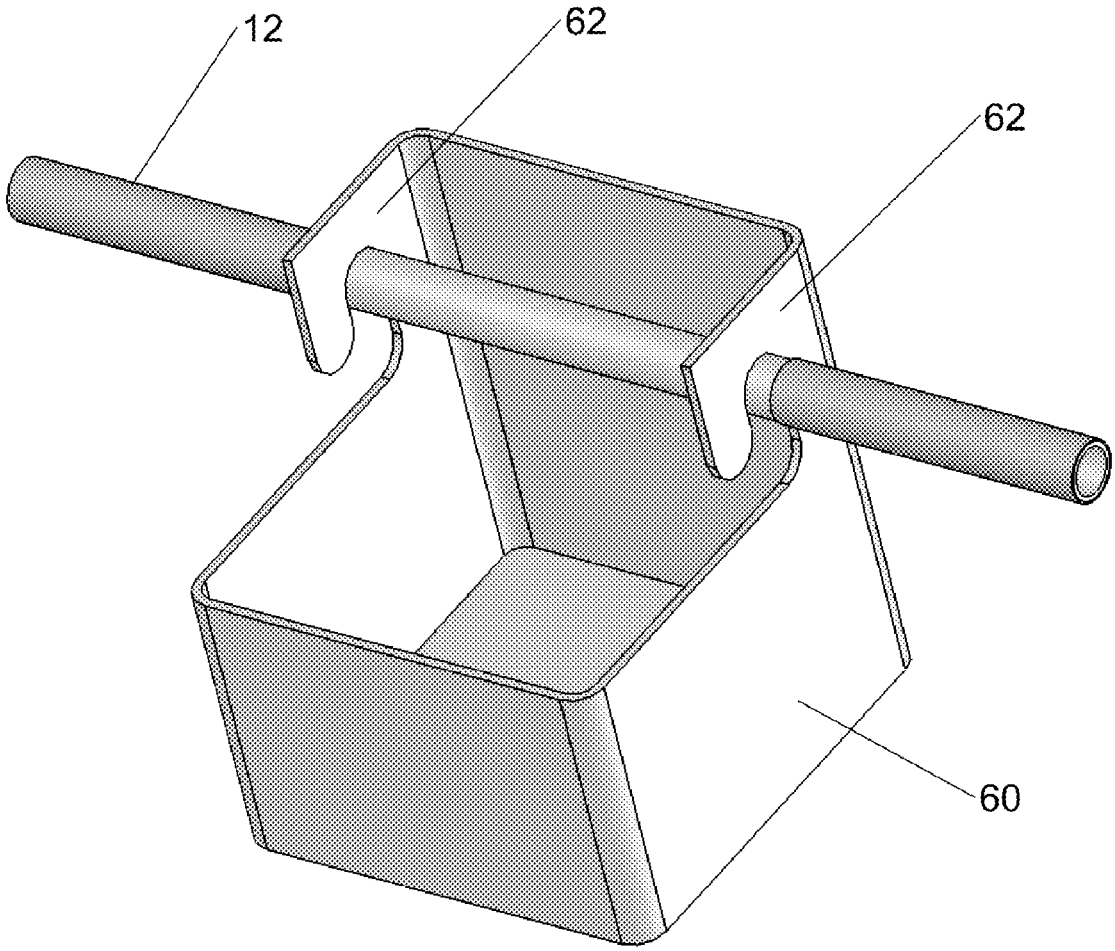
FIG. 7 is a perspective view of a fourth embodiment of the invention.

FIG. 7 illustrates a fourth embodiment of the invention. In this embodiment, the container 60 has an approximately square shape at its top rim and includes a pair of aligned openings in the form of ear loops 62 that extend above the top rim of the container. These ear loops are affixed to the container at only one end and take the shape of an inverted J.

Figure 8:
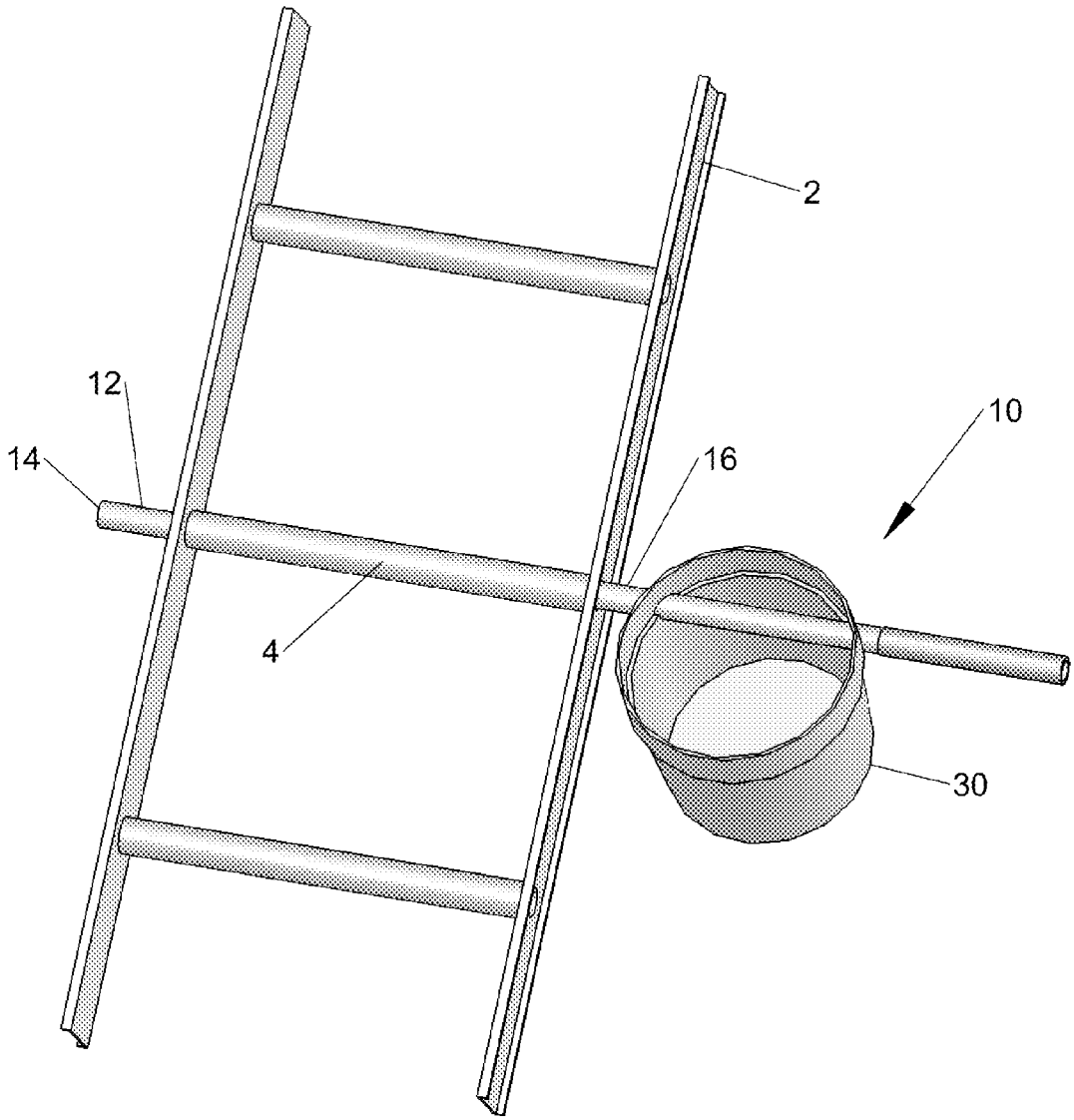
FIG. 8 is a perspective view of a fifth embodiment of the invention, shown installed on a hollow rung ladder.

FIG. 8 illustrates a fifth embodiment of the invention. In this embodiment the rung insert member 12 includes a rung insertion portion 14, 16 of sufficient length that it extends all the way through the hollow rung 4 of the ladder 2 and extends slightly beyond the end of the hollow rung.

Figure 3:
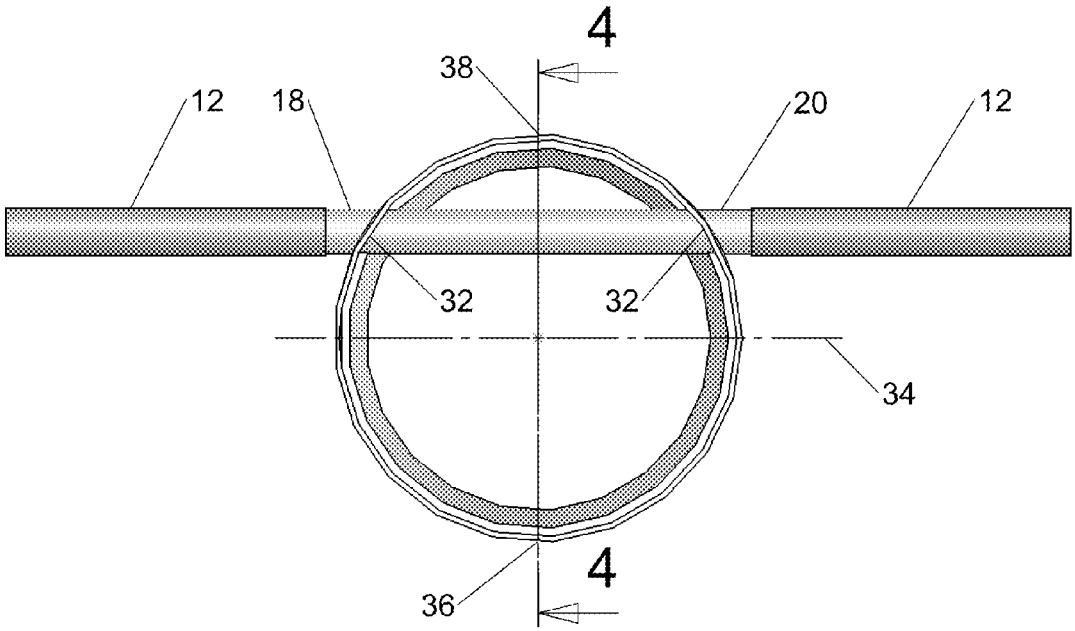
FIG. 3 is a top plan view of the embodiment of FIG. 2.
Figure 4:
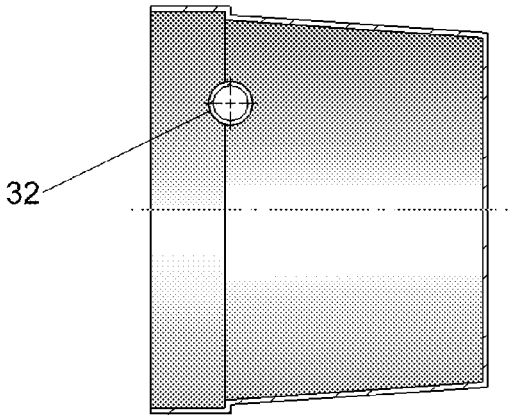
FIG. 4 is a sectional view of the embodiment of FIG. 2 taken along line 4-4 of FIG. 3.
Figure 9:
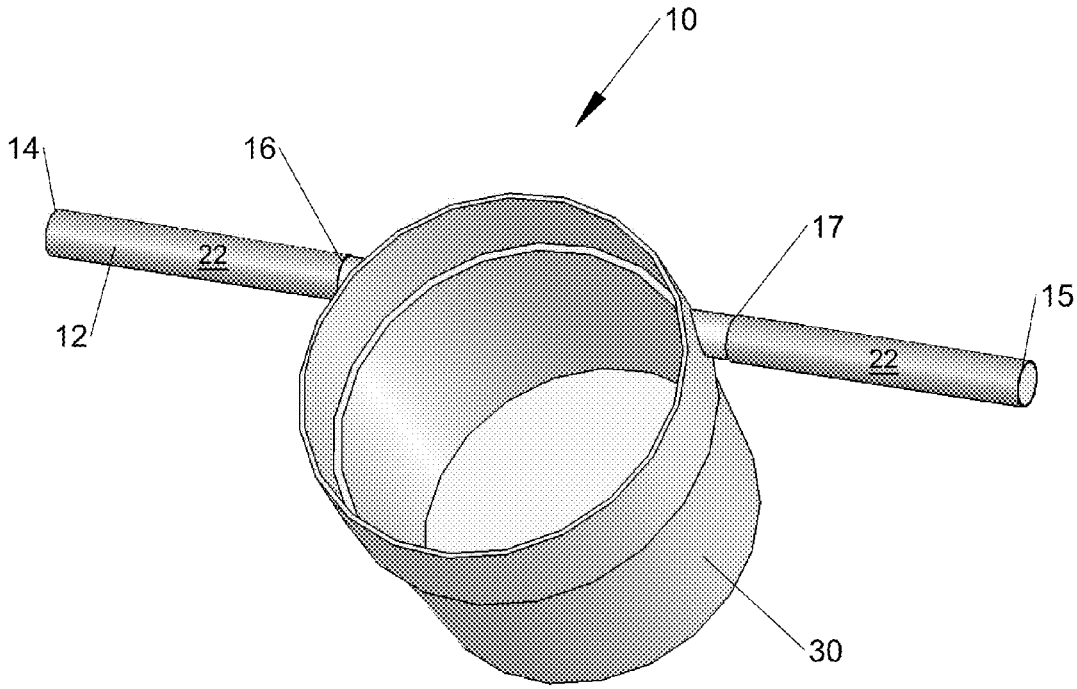
FIG. 9 is a perspective view of a sixth embodiment of the invention.

FIG. 9 illustrates a sixth embodiment of the invention wherein the rung insert member 12 is integral with the container 30, such as, for example, where the rung insert member and the container are molded as a single unit. In this embodiment, the container will not have openings 32 as in previously described embodiments (see FIGS. 2-4), and the rung insert member will not have a container holding portion 18, 20 as previously described. Rather the rung insertion portion 14, 16 of the rung insert member will extend outwardly from the side of the container. Preferably this embodiment will also include an additional rung insertion portion 15, 17 that extends outwardly from the opposite side of the container. The rung insertion portion 14, 16 and the additional rung insertion portion 15, 17 are axially aligned. The rung insert member is located in proximity to the uppermost portion of the container and is offset rearwardly from the central horizontal axis 34 of the container (as shown in FIG. 3), thereby allowing the container to tip forwardly, at least slightly to moderately, when the container includes liquid material. Preferably, the rung insertion portion and the additional rung insertion portion will each comprise an elastomeric surface 22.

The present invention also embraces a ladder and container device assembly comprising a hollow rung ladder and a container device as previously described, wherein the rung insertion portion of said container device is inserted at least partway into the opening of one of the hollow rungs of said ladder. In addition, the present invention embraces a method of attaching a container to a hollow rung ladder comprising providing a container device as previously described and inserting the rung insertion portion of said container device at least part-way into the opening of one of the hollow rungs of said ladder.

It should be understood that the foregoing description illustrates several embodiments of the invention, but the invention is not limited to these embodiments. The invention is intended to embrace all embodiments falling within the scope of the limitations set forth in the following claims as well as any equivalents thereto.

What is claimed is:

1. A container device for use with a hollow rung ladder having a plurality of hollow rungs, each rung having an opening that extends therethrough, the container device comprising, in combination, a rung insert member and a container for holding a liquid material therein;

the rung insert member comprising a rung insertion portion, a container holding portion and an additional rung insertion portion, wherein the rung insertion portion extends from one end of the rung insert member to a first predetermined point along the length of the rung insert member, the additional rung insertion portion extends from the other end of the rung insert member to a second predetermined point along the length of the rung insert member, and the container holding portion is located between the rung insertion portion and the additional rung insertion portion and extends partway along the length of the rung insert member, wherein each of the rung insertion portion and the additional rung insertion portion is cross-sectionally dimensioned to fit within the opening of said hollow rung and has a length sufficient to enter at least about five inches into said hollow rung;

the container having a base and a continuous surrounding sidewall that extends upwardly from the base to an open upper rim, wherein the upper rim has a first diameter and the base has a second diameter that may be the same or smaller than the first diameter, and including a pair of aligned openings located near the open upper rim that are dimensioned and arranged to permit the container holding portion of said rung insert member to be inserted there-through and thereby support the container, wherein said pair of aligned openings is offset rearwardly from the central horizontal axis of said container, thereby allowing the container to tip forwardly when the container includes liquid material;

and wherein the container holding portion of said rung insert member has a length at least sufficient to pass through said pair of aligned openings in said container.

2. The container device according to claim 1 wherein the rung insertion portion and the additional rung insertion portion each comprise an elastomeric surface.

3. The container device according to claim 2 wherein the open upper rim lies substantially in a plane.

4. The container device according to claim 3 wherein said pair of aligned openings is in the form of ear loops that extend above the open upper rim of the container, each of said ear loops being affixed to the container at each end of the loop.

5. The container device according to claim 3 wherein said pair of aligned openings is in the form of ear loops that extend above the open upper rim of the container, each of said ear loops being affixed to the container at only one end of the loop.

6. The container device according to claim 3 wherein each of the rung insertion portion and the additional rung insertion portion is cross-sectionally dimensioned to snugly, but removably, fit within the opening of said hollow rung.

7. The container device according to claim 3 wherein the rung insertion portion is about 6 to 8 inches in length, the additional rung insertion portion is about 6 to 8 inches in length, the container holding portion is about 10 to 12 inches in length, the distance between the container holding portion and the rung insertion portion is about 0 to 4 inches, and the distance between the container holding portion and the additional rung insertion portion is about 0 to 4 inches.

8. The container device according to claim 2 wherein the elastomeric surface has a surface pattern.

9. The container device according to claim 2 wherein said pair of aligned openings is located below the open upper rim of the container.

10. The container device according to claim 1 wherein said pair of aligned openings is in the form of ear loops that extend above the open upper rim of the container, each of said ear loops being affixed to the container at each end of the loop.

11. The container device according to claim 1 wherein said pair of aligned openings is in the form of ear loops that extend above the open upper rim of the container, each of said ear loops being affixed to the container at only one end of the loop.

12. The container device according to claim 1 wherein the container includes a stepped bottom surface.

13. A container device for use with a hollow rung ladder having a plurality of hollow rungs, each rung having an opening that extends therethrough, the container device comprising, in combination, a rung insert member and a container for holding a liquid material therein, wherein the container has a base and a continuous surrounding sidewall that extends upwardly from the base to an open upper rim and wherein the rung insert member is integral with the container and located near the open upper rim of the container;

the rung insert member comprising a rung insertion portion that extends outwardly from one side of the container and an additional rung insertion portion that extends outwardly from an opposite side of the container, wherein the rung insertion portion and the additional rung insertion portion are axially aligned and offset rearwardly from the central horizontal axis of the container, but do not pass through openings in the container, wherein each of the rung insertion portion and the additional rung insertion portion is cross-sectionally dimensioned to fit within the opening of said hollow rung and has a length sufficient to enter at least about five inches into said hollow rung.

14. The container device according to claim 13 wherein the rung insertion portion and the additional rung insertion portion each comprise an elastomeric surface.

15. The container device according to claim 13 wherein the open upper rim lies substantially in a plane.

16. The container device according to claim 13 wherein each of the rung insertion portion and the additional rung insertion portion is cross-sectionally dimensioned to snugly, but removably, fit within the opening of said hollow rung.

17. A container device for use with a hollow rung ladder having a plurality of hollow rungs, each rung having an opening that extends therethrough, the container device comprising, in combination, a rung insert member and a container for holding a liquid material therein;

the rung insert member comprising a rung insertion portion that extends from one end of the rung insert member to a predetermined point along the length of the rung insert member, and a container holding portion that extends partway along the length of the rung insert member, wherein the rung insertion portion comprises an elastomeric surface, is cross-sectionally dimensioned to fit within the opening of said hollow rung and has a length sufficient to enter at least about five inches into said hollow rung;

the container having a base and a continuous surrounding sidewall that extends upwardly from the base to an open upper rim, wherein the open upper rim lies substantially in a plane, and including a pair of aligned openings located near the open upper rim that are dimensioned and arranged to permit the container holding portion of said rung insert member to be inserted there-through and thereby support the container, wherein said pair of aligned openings is offset rearwardly from the central horizontal axis of said container, thereby allowing the container to tip forwardly when the container includes liquid material;

and wherein the container holding portion of said rung insert member has a length at least sufficient to pass through said pair of aligned openings in said container.

18. The container device according to claim 17 wherein the rung insertion portion is cross-sectionally dimensioned to snugly, but removably, fit within the opening of said hollow rung.

19. The container device according to claim 17 wherein said pair of aligned openings is located below the open upper rim of the container.

20. The container device according to claim 17 wherein the upper rim has a first diameter and the base has a second diameter that may be the same or smaller than the first diameter.

* * * * *